US005412179A

United States Patent [19]

Chen

[11] Patent Number: 5,412,179

[45] Date of Patent: May 2, 1995

[54] PUSH BUTTON IGNITION SWITCH FOR CONTROLLING GAS FLOW AND IGNITER IN AN IGNITION GUN

[76] Inventor: Lin-Tien Chen, 3 Fl., No. 174, Tzu Chiang Str., Taipei, Taiwan, Prov. of China

[21] Appl. No.: 107,085

[22] Filed: Aug. 17, 1993

[51] Int. Cl.[6] ..... F23Q 7/00; H01H 9/06

[52] U.S. Cl. ..... 219/262; 219/221; 126/401; 431/256; 431/254; 431/258; 200/61.86; 200/293.1

[58] Field of Search ..... 219/262, 227; 126/401–409, 413, 414, 238, 234; 431/256, 257, 254, 258; 38/84, 85; 200/293.1, 61.86, 307

[56] References Cited

U.S. PATENT DOCUMENTS 4,688,552 8/1987 Tsai ..... 126/414
4,920,952 5/1990 Nakajima ..... 126/401
5,215,456 6/1993 Fujiwara ..... 126/406

FOREIGN PATENT DOCUMENTS 2624254 6/1989 France .
3410577 12/1984 Germany ..... 126/413

*Primary Examiner*—John A. Jeffery
*Attorney, Agent, or Firm*—Bacon & Thomas

[57] ABSTRACT

A push button type ignition switch for controlling the operation of an electronic igniter operated flame ignition type ignition gun, whereby the electronic igniter of the ignition gun is turned on to produce sparks as the button of the switch is depressed; a flow of gas is ejected from a gas tank for making a flame by the sparks as the base of the switch is moved forward after the button of the switch depressed; the base of the switch is stopped by a stop plate to close the gas tank as the button of the switch is released.

2 Claims, 2 Drawing Sheets

PUSH BUTTON IGNITION SWITCH FOR CONTROLLING GAS FLOW AND IGNITER IN AN IGNITION GUN

BACKGROUND OF THE INVENTION

The present invention relates to an ignition switch for controlling the operation of an electronic igniter operated flame ignition type ignition gun, which can be alternatively controlled to produce sparks only, or to make a flame.

Various ignition guns have been disclosed, and have appeared on the market. These ignition guns are commonly gathered into two groups. The first group of ignition guns are controlled to produce sparks only. The second group of ignition guns are controlled to produce a flame. Different types of ignition guns may be used for different purposes. It is not economic to prepare two different types of ignition guns.

SUMMARY OF THE INVENTION

The present invention has been accomplished under the aforesaid circumstances. It is therefore the principal object of the present invention to provide an ignition switch for a flame ignition type ignition gun which controls the ignition gun to produce sparks, or to make a flame alternatively.

BRIEF DESCRIPTION OF THE DRAWINGS

FIG. 3 is similar to FIG. 2 but showing the ignition switch switched on.

DETAILED DESCRIPTION OF THE PREFERRED EMBODIMENT

Figure 1:
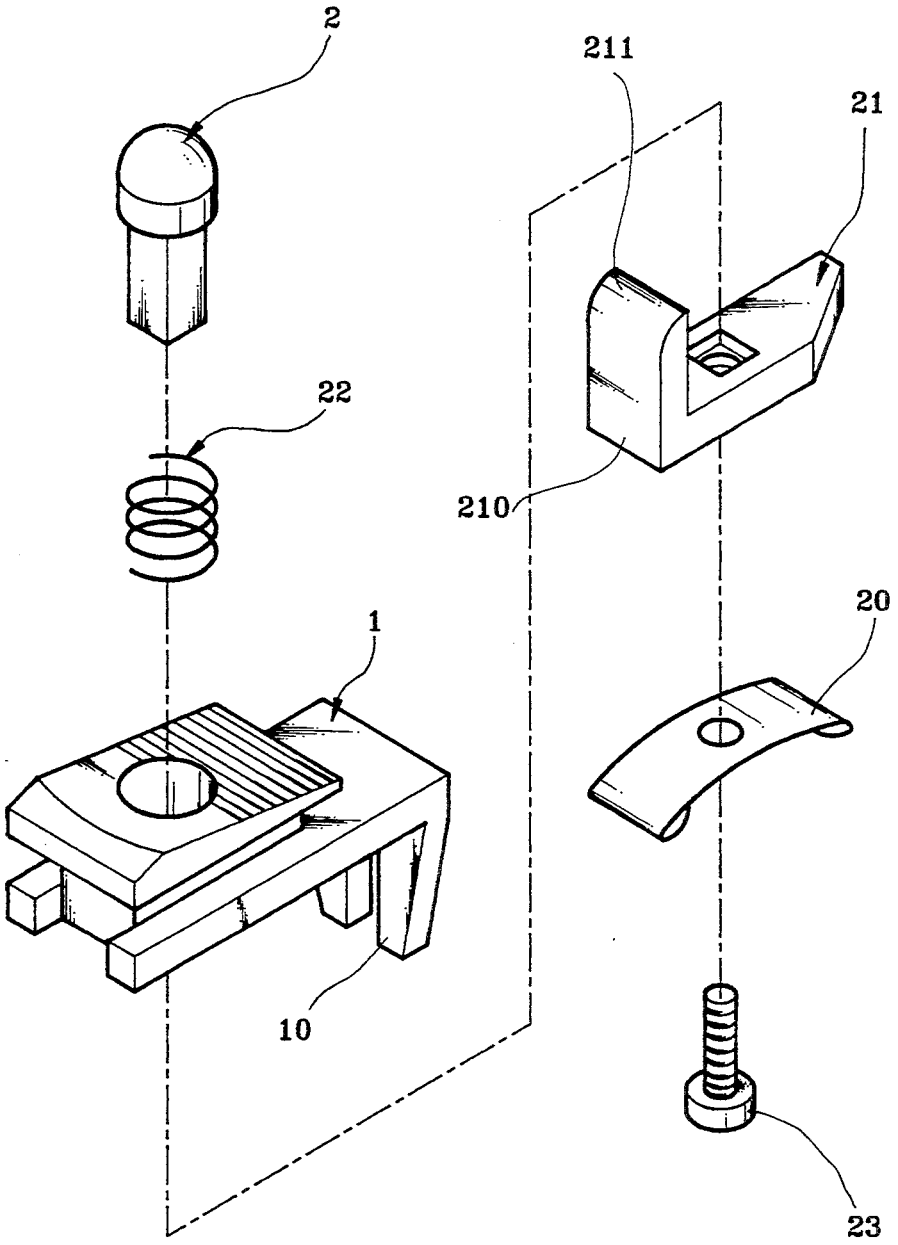
FIG. 1 is an exploded view of an ignition switch according to the preferred embodiment of the present invention
Figure 2:
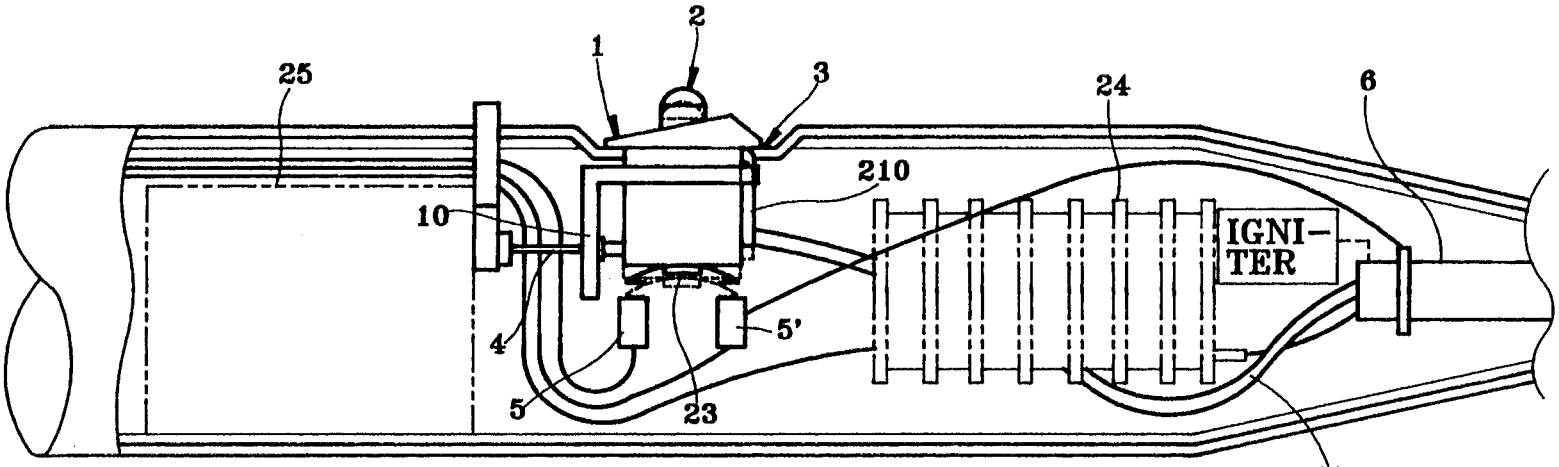
FIG. 2 is a sectional view showing the ignition switch installed in a flame ignition type ignition gun.

Referring to FIGS. 1 and 2, the ignition switch comprises a sliding base 1 made to slide in a sliding way 3 on the outside of the housing of the ignition gun. The sliding base 1 has one end turned downwards at right angles and terminated to a pronged portion 10. As the sliding base 1 is moved forward, the gas valve 4 of the gas tank 25 of the ignition gun is pulled open by the pronged portion 10, and therefore a flow of gas is sent from the gas tank 10 to the flame tube 6 of the ignition gun through a gas tube 40 for making a flame.

A firing button 2 is fastened to the sliding base 1 and supported on a compression spring 22 for firing control. A metal spring plate 20 and a stop plate 21 are fastened to the firing bottom 2 beneath the sliding base 1 by a screw 23. The metal spring plate 20 has two opposite ends respectively disposed above the two opposite contacts 5;5' of the electronic igniter of the ignition gun. The stop plate 21 retained between the metal spring plate 20 and the sliding base 1, having a vertical stop wall 210 stopped against an edge (not shown) on the housing of the ignition gun to stop the sliding base 1 from a horizontal movement.

Figure 3:
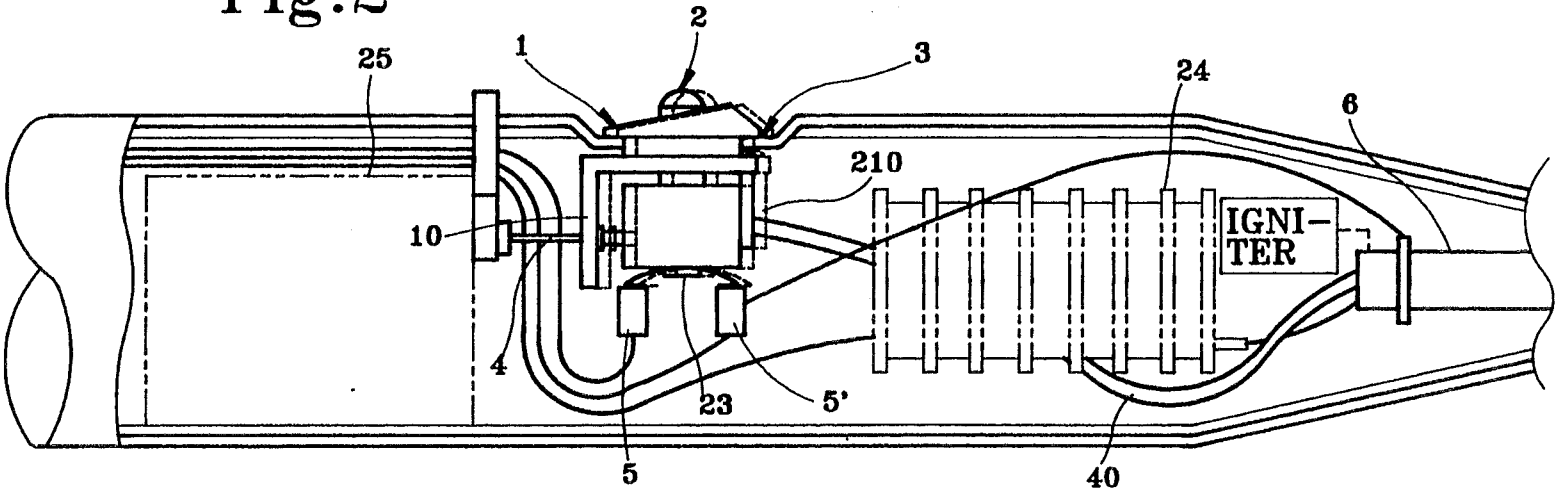

Referring to FIG. 3, as the firing button 2 is depressed, the metal spring plate 20 contacts the contacts 5;5' to electrically connect the high tension coil 24, causing the two opposite electrodes of the electronic igniter to produce sparks for igniting a gas burner. Further, as the firing button 2 is depressed, the vertical stop wall 210 of the stop plate 21 is moved downwards and released from the housing of the ignition gun (see the dotted line), and therefore the sliding base 1 can be moved forward. As the sliding base 1 is moved forward, the gas valve 4 is simultaneously pulled open by the pronged portion 10 of the sliding base 1, to let a flow of gas be ejected out of the flame tube 6 and ignited by the sparks to make a flame. Therefore, the user can alternatively control the ignition switch to make sparks only, or to make sparks and release gas so as to make a flame.

Further, the upper part of the vertical stop wall 210 is made gradually reducing upwards on one side so that the vertical stop wall 210 automatically pushes the sliding base 1 back to its former position to stop the gas valve 4 as the hand is released from the sliding base 1.

I claim:

1. In an electric igniter operated flame ignition type ignition gun, the ignition gun having a housing, an electronic igniter and an ignition switch for controlling the operation of an electronic igniter operated flame ignition type ignition gun, the improvement comprising: a sliding base mounted on the housing of the ignition gun so as to slide horizontally on the housing; a firing button supported on a compression spring so as to slide vertically in a hole on said sliding base; a metal spring plate and a stop plate respectively fastened to said firing button by a screw, whereby said sliding base is stopped by said stop plate from sliding horizontally; said metal spring plate causes the electronic ignition to produce sparks as said firing button is depressed, and at the same time said stop plate is released from said sliding base for allowing said sliding base to be moved forward to open a gas tank for making a flame by the sparks.

2. The ignition switch of claim 1 wherein said stop plate is inserted into the way of the sliding stroke of said sliding base to stop said sliding base from sliding horizontally when said firing button is not pressed.

* * * * *